United States Patent [19]

Bentley

[11] 4,028,013

[45] June 7, 1977

[54] PULSE MULTIPLIER FOR SURFACE OPERATED SINGLE TUBE PUMP

[76] Inventor: Arthur P. Bentley, P.O. Box 88, Arizona City, Ariz. 85223

[22] Filed: Nov. 13, 1975

[21] Appl. No.: 631,726

[52] U.S. Cl. ..... 417/390

[51] Int. Cl.[2] ..... F04B 9/10

[58] Field of Search ..... 417/383, 388, 402, 435; 60/543

[56] References Cited

UNITED STATES PATENTS

| | | | |
|---|---|---|---|
| 2,578,746 | 12/1951 | Scherger et al. | 417/388 |
| 2,847,149 | 8/1958 | Ainsworth | 417/435 |
| 2,973,779 | 3/1961 | Kennedy | 417/435 |
| 3,107,624 | 10/1963 | Williams | 60/543 |
| 3,804,557 | 4/1974 | Bentley | 417/402 |

*Primary Examiner*—William L. Freeh
*Attorney, Agent, or Firm*—John A. Robertson

[57] ABSTRACT

A device for multiplying the effective pulsations on a column of liquid which operates an underground pump. The pulsations are created by a pulse generator at the ground surface and are transmitted through the column of liquid being pumped to operate the underground pump. The pulse multiplier is interposed in the single tube at the ground surface and is effective to partially divert the flow of liquid from the tube to a receiving tank when gas pockets in the column of liquid reach a predetermined degree and relieve the column of the gas pockets by by-passing the liquid under pulsations from the pulse generator back to the receiving tank.

7 Claims, 3 Drawing Figures

PULSE MULTIPLIER FOR SURFACE OPERATED SINGLE TUBE PUMP

The present invention relates to single tube pumps which are located underground and which are operated by impulses which are imparted to the column of liquid being pumped by a pulse generator at the ground surface and is concerned primarily with a device which multiplies the effective pulses on the column of liquid created by the pulse generator.

BACKGROUND OF THE INVENTION

In U.S. Pat. No. 3,804,557 to Bentley, issued Apr. 16, 1974, there is disclosed a single tube surface operated pump which includes as essential elements an underground pump located at the level of the liquid being pumped, and a single tube extending from the underground pump to a pulse generator at the ground surface. The underground pump is operated by pulsations on the column of liquid being pumped which are created by the pulse generator. The latter comprises a cylinder in which a piston is reciprocated from an appropriate power source. The cylinder is formed with a lateral port which communicates with a receiving tank. On a down-stroke of the piston, this port is closed and a pulse is imparted to the column of liquid. Such pulses are transmitted through the column of liquid to the underground pump to operate it.

On the up-stroke of the piston, the lateral port is open and liquid flows into the receiving tank.

It has been found that pockets of air and gas are almost invariably present in the column of liquid. These gas pockets impair the transmission of pulses to the underground pump and, in many instances, are of such a degree as to literally render the pulses ineffective on the underground pump. Thus, by way of example, it is noted that if the pulse generator is operated to create 400 pulses per minute on the column of liquid immediately adjacent to the pulsator, the presence of air and gas in the column of liquid will often reduce the pulses which are effective on the underground pump to only a fraction of those which are generated by the pulse generator. Thus, with the latter generating 400 pulses per minute, only 100 pulses would be effective on the underground pump.

The present invention is founded on the basic concept of increasing or multiplying the pulses which are effective on the underground pump by eliminating pockets of gas and air in the column of liquid.

OBJECTS OF THE INVENTION

With the foregoing conditions in mind, the present invention has in view the following objectives:

1. To provide a pulse multiplier which is interposed in the tube through which the column of liquid is pumped between the ground level and pulse generator.

2. To provide a pulse multiplier, of the type noted, which automatically paritially diverts the flow of liquid to the receiving tank through the pulse generator when the pressure of gas in the column of liquid reaches a predetermined degree.

3. To provide, in a pulse multiplier of the character aforesaid, a by-pass for liquid under pulsations from the pulse generator which passes through the upper portion of the column of liquid in which the gas is entrapped and relieves the gas pressure by entraining the gas in the liquid which is passed back to the receiving tank.

4. To provide a pulse multiplier, of the kind described, which is literally ineffective on the column of liquid when the latter is substantially solid but which is rendered effective to relieve the column of liquid of gas pockets when the pressure of the latter reaches a predetermined degree.

Various other more detailed objects and advantages of the invention, such as arise in connection with carrying out the above ideas in a practical embodiment will, in part, become apparent and in part be hereinafter stated as the description of the invention proceeds.

SUMMARY OF THE INVENTION

The foregoing objectives are achieved by providing a pulse multiplier which is interposed in the tube of a single tube surface operated pump between the ground level and a pulse generator. The latter includes a cylinder with a piston reciprocating therein and formed with a lateral port which communicates with a receiving tank. A tube extends from the effecitve end of the cylinder to a radial port in the multiplier casing. The latter is formed with a bore at its lower end to which the upper end of the tube containing the column of liquid is connected. The port aforesaid opens on to this bore. The casing is counterbored above the aforesaid lateral port and this counterbore is enlarged substantially midway of the casing. The counterbore is continued above the enlargement and terminates at its upper end in a shoulder on to which a central passage opens from the upper end of the casing.

A piston is positioned in the bore, counterbore, and enlargement and comprises three sections: The lowermost section is received in the bore immediately above the lower end and is formed with an enlarged portion constituting the section that is received in the counterbore. This lower section is formed with an axial passage which extends from its lower end onto which it opens to radial passages in the enlarged portion. The lower section of the piston is formed with an external annular recess which communicates with the lateral port and with radial passages which communicate with the annular recess.

That portion of the piston which is received in the counterbore is continued beyond the counterbore enlargement and is formed on it upper face with a socket constituting a spring abutment as will be later described. From the latter portion of the piston a rod of a diameter which provides for its being snugly received in the passage in the casing end extends upwardly. This rod is formed with an end portion of reduced diameter providing a shoulder for a purpose to be later described.

An expansion coil spring is disposed about this rod and is interposed between the socket on the enlarged part of the piston and the upper end wall of the counterbore.

The casing is formed with a second radial port in the lower end of the counterbore and a conduit is connected to this port. This conduit extends back to the receiving tank.

Immediately above the upper end of the counterbore the casing is formed with a radial passage. A ball detent at the inner end of this passage is urged against the reduced end extension of the rod and the shoulder defined by this extension and the main body portion of the rod. The ball detent is urged radially inwardly by an expansion coil spring which is backed by a screw plug which may be adjusted to vary the tension on the spring.

With the column of liquid in the tube solid or substantially solid and free of gas or air pockets, the apparatus operates in the manner described in the patent above identified. Thus, on a down-stroke of the piston of the pulse generator the lateral port in the cylinder is closed and a pulse is imparted to the column of liquid. The pulse is transmitted through the tube which extends from the lower end of the cylinder to the lateral port in the multiplier casing. From this lateral port the liquid passes to the annular recess in the lower piston section. From this annular recess the liquid passes through the radial ports in the lower piston section to the axial passage therein and thence to the upper end of the tube containing the column of liquid.

The enlarged piston section is forced downwardly by the spring in the counterbore and in this position the enlarged portion of the counterbore is closed as is the lateral port to which the tube which goes back to the receiving tank is connected. Moreover, the piston is held in this position by the ball detent which engages the shoulder at the upper end of the piston rod.

When the pressure of gas or air which has accumulated in the column of liquid reaches a predetermined degree, it is effective on the lower end of the piston and surfaces in the enlarged portions in the counterbore to move the piston upwardly by overcoming the holding effects of the ball detent. The piston is now in position in which the pulse multiplier becomes effective to eliminate the air and gas pockets. Thus, the flow of liquid under pulsations is through the lateral port, the annular recess in the lower piston section, through the radial passages and counterbore, to the lateral port which communicates with the receiving tank. The liquid will also pass through the central passage and occupy the space in the counterbore and the counterbore enlargement. Gas pockets in the column of liquid will naturally rise and accumulate in these spaces. Thus it is removed by being entrained in the liquid as it passes through the multiplier in the manner aforesaid.

After the gas pressure is relieved the spring is effective to return the piston to its lowermost position in which it is held by the ball detent and normal operation is restored in which the pulses are multiplied from the number which were effective when the gas pockets were present.

For a full and more complete understanding of the invention, reference may be had to the following description and accompanying drawings wherein.

DESCRIPTION OF A PREFERRED EMBODIMENT

Figure 1:
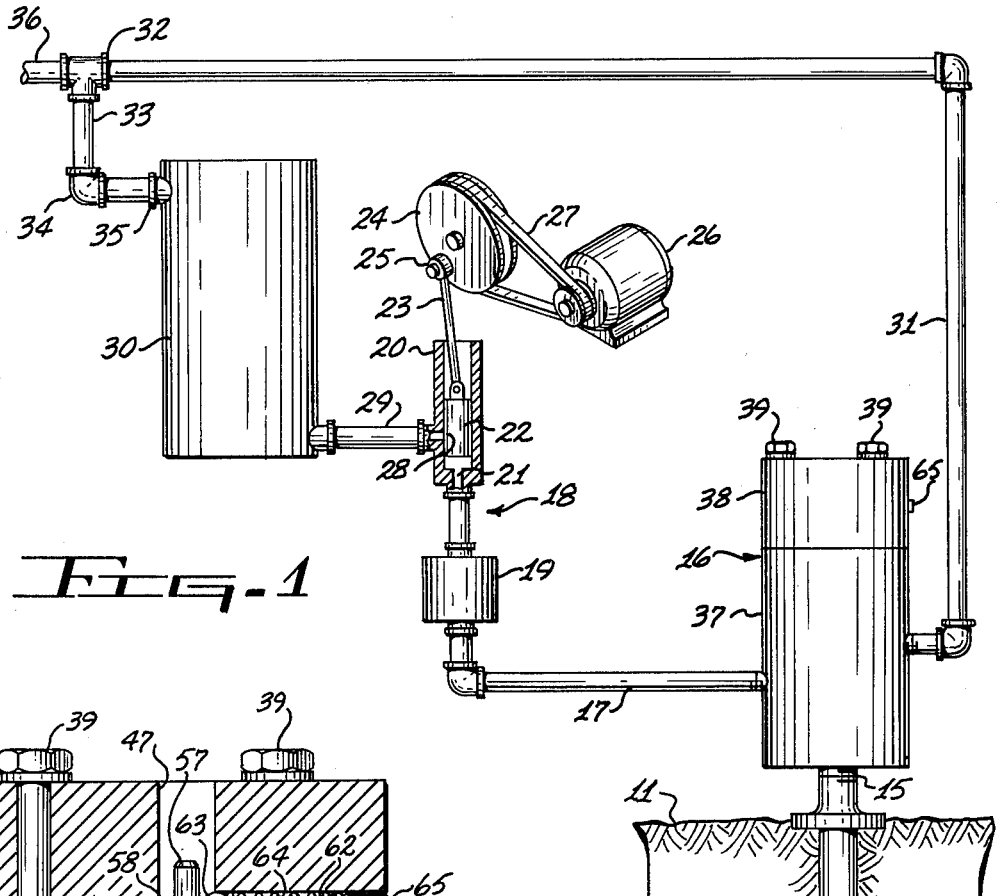
FIG. 1 is a side elevation of a single tube surface operated pump including the pulse multiplier of this invention.

Referring now to the drawings wherein like elements are identified by the same reference characters throughout the several views, and first more particularly to FIG. 1: A ground formation is designated as 10 and shown as having an upper surface 11 and a liquid bearing layer 12 in which a pump 13 is located. This pump 13 is of the type illustrated in the patent aforesaid. Upstanding from pump 13 and passing through a hole in the ground formation 10 is a tube 14 through which pumped liquid passes.

The upper end of tube 14 is threaded as indicated at 15 and connected to the pulse multiplier of this invention which is referred to in its entirety at 16. From one side of 16 a conduit 17 extends to a pulse generator designated generally 18. A check valve represented diagrammatically at 19 may be included in the conduit 17.

Pulse generator 18 comprises a cylinder 20 which is open at its upper end and has a passage 21 at its lower end which communicates with conduit 18. A piston 22 is reciprocal in cylinder 20 and may be driven by any appropriate device. By way of example it is noted that a piston rod 23 is connected at one end to piston 22 and its other end to a fly wheel 24 as indicated at 25. Fly wheel 24 is driven from a motor 26 by a drive belt 27.

Cylinder 20 is formed with a lateral port 28 which communicates with a pipe 29 that extends to a receiving tank 30.

From the other side of pulse multiplier 16, a by-pass conduit 31 extends to a T fitting 32. From the latter a pipe 33 extends to an L 34 which communicates with receiving tank 30 as indicated at 35. A line shown at 36 also extends from T fitting 32 to a storage receptacle.

Figure 2:
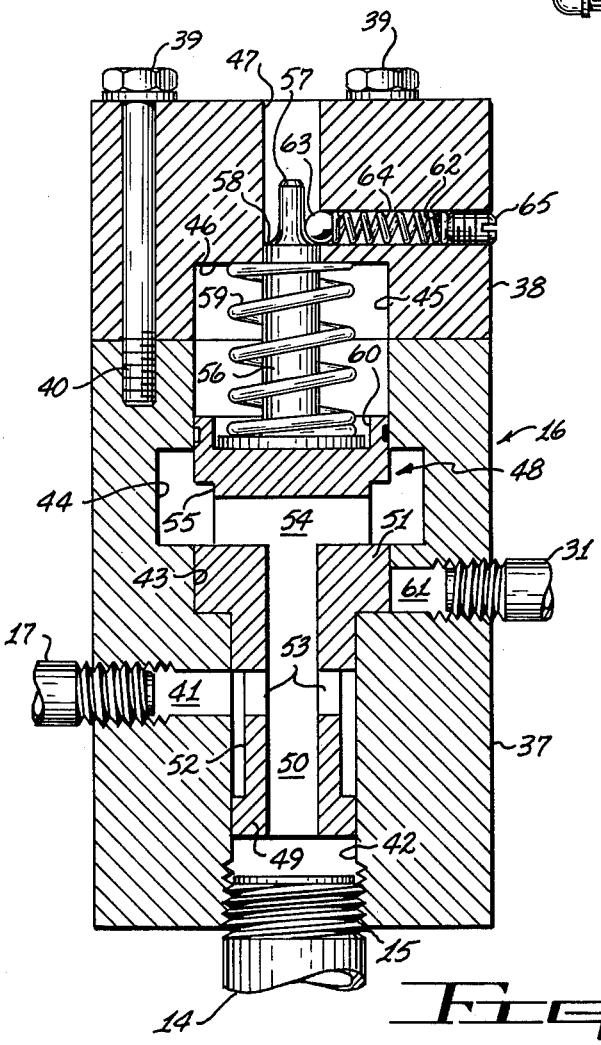
FIG. 2 is a vertical section through the multiplier in the position in which all of the impulses created by the pulse generator are effective on the underground pump.
Figure 3:
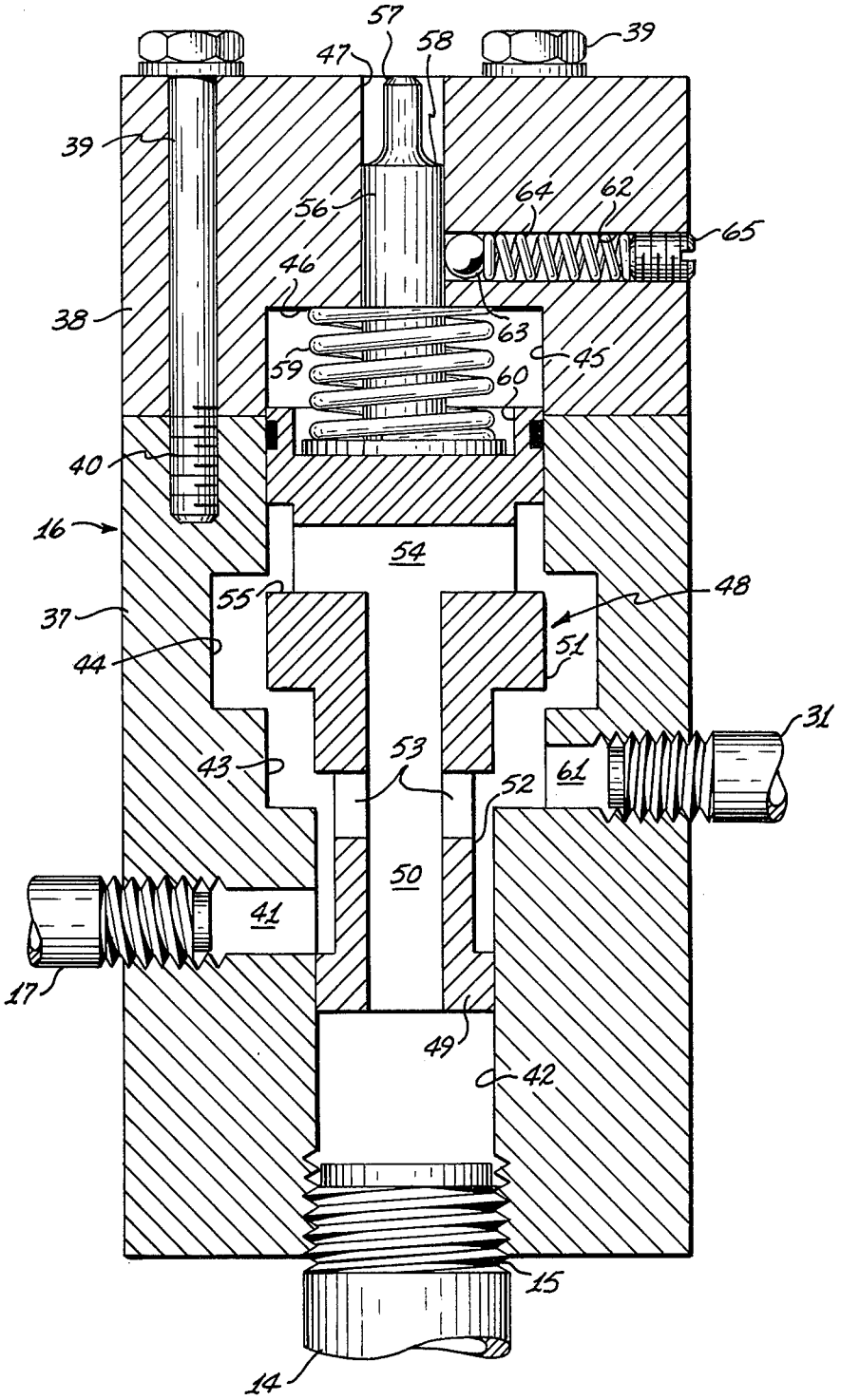
FIG. 3 is a view similar to FIG. 2 taken on an enlarged scale illustrating the position of the piston when a portion of the pulsed liquid from the pulse generator is diverted to be by-passed back to the receiving tank.

Referring now more particularly to FIGS. 2 and 3, pulse multiplier 16 includes a casing comprising a lower casing part 37 and an upper casing part 38. The parts are maintained in assembled relation by screw bolts 39 which have threaded ends 40 received in threaded sockets in casing part 37.

Casing part 37 is formed with a lateral port 41 the outer end portion of which is threaded to provide for the connection of conduit 17 thereto. Lower casing part 37 is also formed with a longitudinal bore 42 with the latter being counterbored as indicated at 43. Counterbore 43 is continued to the upper end of lower casing part 37 but its diameter is increased to provide a central enlargement 44. Upper casing part 38 is formed with a cylinder socket 45, the diameter of which is the same as counterbore 43 whereby it is constituted a continuation of said counterbore. Socket 45 presents an upper surface 46 onto which opens a passage 47 centrally thereof.

A valve piston is referred to in its entirety at 48 and comprises three sections which are integrally connected. Thus valve piston 48 includes a lower piston section 49 which is slidably received in bore 42. Piston section 49 is formed with a central passage 50 which opens onto its lower face and extends upwardly into a head or enlarged piston section 51. Piston section 49 is formed with an annular recess 52 which communicates with lateral port 41. It is also formed with radial passages 53 which communicate between axial passage 50 and annular recess 52.

Piston head 51 is formed with a diametric passage 54 which communicates with the upper end of axial passage 50. Piston head 51 is also formed with an annular groove 55 with which diametric passage 54 communicates. Extending from the upper end of piston head 51 and centrally thereof is a rod 56 which is snugly and slidaby received in passage 47 and upper casing part 38. Rod 56 terminates in a reduced end portion 57 which is defined by a shoulder 58.

An expansion coil spring 59 is disposed about rod 56 and bears against surface 46 at its upper end and the bottom surface of a socket 60 formed in piston head 51.

Lower casing part 37 is formed with a second lateral port 61 which opens onto counterbore 43 at its lower end and which is threaded at its outer end to provide for the connection thereto of conduit 31. Ports 41 and 61 are preferably diametrically opposed to each other in their position in casing part 37. Upper casing part 38 is formed with a radial passage 62 which extends from passage 47 onto which it opens to the exterior of the casing. A ball detent 63 is positioned at the inner end of passage 62 and is adapted to assume either of the positions illustrated in FIGS. 2 and 3. In FIG. 2 ball detent 63 is urged inwardly against shoulder 58 by an expansion coil spring 64. Spring 64 is backed by an abutment plug 65 which is screwed into an outer threaded portion of passage 64 and hence is adjustable. This permits variation in the force applied to the ball detent 63.

OPERATION OF A PREFERRED EMBODIMENT

While the manner in which the subject pulse multiplier operates is believed to be obvious from the illustrations of the drawings and description of parts set forth above, it is briefly outlined as follows:

With the column of liquid in tube 14 substantially solid and free of gas pockets to the extent which would materially impair the transmission of pulses from pulse multiplier 18 to underground pump 13, pulse multiplier 16 is in the position depicted in FIG. 2.

In this position the piston 48 is in its lowermost position and lower piston section 49 shuts off communication between lateral ports 41 and 61. Thus liquid with pulsations imparted thereto by pulse generator 18 passes from conduit 17 and port 41 and through annular recess 52 and radial passages 53 to axial passage 50. They are therefor effective on the column of liquid in tube 14 to operate pump 13.

When air and pockets of air and gas are present in this column of liquid they are in the first instance effective to impair the transmission of pulses to pump 13. They rise in the column and collect in pulse multiplier 16. When the pressure of these gases on the lower end surface of piston section 49 and the upper surface of annular recess 55 in the enlarged portion of the piston reach a predetermined degree, piston 48 is moved upwardly against the influence of spring 59 and the holding effect of ball detent 63. Thus when a limit of pressure is reached ball detent 63 is forced outwardly by the caming effect of shoulder 58 and the piston assumes the position depicted in FIG. 3.

In this position liquid under pulsation is admitted through lateral port 41 into annular recess 52 into counterbore 43, and out through lateral port 61 to conduit 31. At the same time, a portion of this liquid will pass through radial passage 53 into axial passage 50 and also from the enlarged portion 44 of the counterbore and diametric passage 54 into the axial passage 50. Thus, a substantial portion of the liquid under pulsation is passed through the counterbore and entrains gas which is present therein and passes this gas along with the liquid out through lateral port 61 and back to a storage receptacle from which it escapes in a well known manner. Thus the gas pressure is relieved and as it is relieved spring 59 returns piston 48 to the position of FIG. 2 and the maximum transmission of pulses to pump 13 is restored.

Thus, with piston 48 in the position of FIG. 3, all of the lower surfaces of piston 48 are exposed to gas pressure, and these combined surfaces are much greater than, and in fact a multiple of the lower end surface of piston 48. This means that spring 59 is continued to be overcome by gas pressure until substantially all of the gas is eliminated from the spaces in casing 37 - 38.

While a preferred specific embodiment of the invention is herein disclosed it is to be clearly understood that the invention is not limited to the exact constructions, mechanisms, and devices illustrated and described because various modifications of these details may be provided in putting the invention into practice.

What is claimed is:

1. In a single tube surface operated pump including a. an underground pump that is operated by pulses on a column of the liquid being pumped, b. a tube extending from said pump to a ground surface and containing said column of liquid, c. a receiving tank at said ground surface, and d. a pulse generator comprising:

I. a cylinder having a lateral port communicating with said receiving tank,

II. a piston reciprocal in said cylinder, and

III. power means for reciprocating said piston, a pulse multiplier for increasing the pulses created by said generator which are effective on said column of liquid, said pulse multiplier being connected at one side to the lower end of said cylinder, at the other side to said receiving tank and comprising:

e. a casing having a bore one end of which is connected to the upper end of said tube, f. a first lateral port in said casing to which a conduit from the end of said cylinder is connected, g. a second lateral port in said casing and connected to a conduit from said receiving tank, h. a piston reciprocal in said casing, i. a spring in said casing biasing said piston into a position in which there is a direct flow of the liquid of said column from said first lateral port to said cylinder under the influence of said underground pump which is operated by pulses created by said pulse generator, j. surfaces on said piston in the casing which are exposed to gas pockets in said column of liquid and tending to displace said piston from its position providing said direct flow, and k. a yieldable detent holding said piston in said position until the pressure of said gas pockets on said piston surface reaches a predetermined degree, whereupon said detent yields and said piston in said casing is moved by gas pressure into a position in which a portion of the liquid from said column is diverted to the second lateral port and is delivered to said receiving tank, said diverted liquid entraining gas in said casing and thereby relieving the gas pressure to permit said spring to return the piston in said casing into its position providing said direct flow of liquid.

2. The pulse multiplier of claim 1 in which said bore is counterbored intermediate its ends, the counterbore further enlarged centrally thereof and a passage of reduced diameter extends from the end of the bore to the end of the casing remote from the end connected to said tube, and the piston includes a lower section snugly slidable in said bore, a piston head snugly slidable in said counterbore, and a piston rod snugly slidable in said passage.

3. The pulse multiplier of claim 2 in which said spring is an expansion spring coiled about said piston rod and having one end seated in a recess in the end of said piston head with its other end abutting a surface at the end of and normal to said counterbore.

4. The pulse multiplier of claim 2 in which the lateral ports in the casing are offset with respect to each other and the lower piston section is formed with an external annular recess of a diametric length spanning the offset between said lateral ports.

5. The pulse multiplier of claim 4 in which the piston in the casing has an axial passage extending from the lower end of the lower piston section to a point spaced from the end of said piston head, radial passages in said lower piston section connecting said annular recess and said axial passage, and a diametric passage in said piston head at the end of said axial passage.

6. The pulse multiplier of claim 2 in which the piston rod has an end portion of reduced diameter with a curved shoulder between said piston rod and said rod and said end portion, a radial passage in said casing opening onto said shoulder when said piston is in said position of direct flow, and the detent takes the form of a spring biased ball in said passage engaging said shoulder.

7. The pulse multiplier of claim 3 in which the casing comprises lower and upper casing parts secured in assembled relation by screw bolts with the upper casing part being formed with a socket constituting an extension of said counterbore, at the radial passage for said ball detent.

* * * * *